US007370588B2

(12) United States Patent
Franco

(10) Patent No.: US 7,370,588 B2
(45) Date of Patent: May 13, 2008

(54) SYSTEM FOR RAPIDLY FIXING A CLOTH TO A TABLE OR OTHER FLAT SURFACE

(75) Inventor: Pasqualino Franco, Borgomanero (IT)

(73) Assignee: Effepi SRL, Gattico (IT)

( * ) Notice: Subject to any disclaimer, the term of this patent is extended or adjusted under 35 U.S.C. 154(b) by 166 days.

(21) Appl. No.: 10/509,387

(22) PCT Filed: Apr. 19, 2002

(86) PCT No.: PCT/IT02/00251

§ 371 (c)(1),
(2), (4) Date: Sep. 27, 2004

(87) PCT Pub. No.: WO03/079870

PCT Pub. Date: Oct. 2, 2003

(65) Prior Publication Data

US 2005/0251957 A1 Nov. 17, 2005

(30) Foreign Application Priority Data

Mar. 26, 2002 (IT) ..... PI2002A0016

(51) Int. Cl.
*A47B 13/08* (2006.01)

(52) U.S. Cl. ..... 108/90; 150/158

(58) Field of Classification Search ..... 108/90; 150/158, 154; 160/123, 126, 350, 368.1, 160/330, 392, 395; 24/460, 462
See application file for complete search history.

(56) References Cited

U.S. PATENT DOCUMENTS 2,104,261 A * 1/1938 Landau ..... 160/392
2,509,037 A * 5/1950 Flicker ..... 108/27
3,229,029 A * 1/1966 Weiss ..... 174/101
3,464,480 A * 9/1969 Kuss ..... 160/368.1
3,489,410 A * 1/1970 Petras et al. ..... 473/28
3,757,479 A * 9/1973 Martinez ..... 52/222
3,805,873 A * 4/1974 Bloomfield ..... 160/392
3,928,897 A * 12/1975 Tombu ..... 24/462
3,984,958 A * 10/1976 Murray ..... 52/468
4,057,095 A * 11/1977 Hirota ..... 160/392
4,103,728 A * 8/1978 Burdette et al. ..... 160/368.1
4,107,826 A * 8/1978 Tysdal ..... 24/460
4,153,097 A 5/1979 Pettibone
4,170,810 A * 10/1979 Peleg ..... 24/462
4,333,284 A * 6/1982 Meadows ..... 52/222
4,410,027 A * 10/1983 Lucous ..... 160/380
4,662,038 A * 5/1987 Walker ..... 24/460
4,949,523 A * 8/1990 Kassem ..... 52/713

(Continued)

FOREIGN PATENT DOCUMENTS

NL 1004932 * 7/1998

*Primary Examiner*—Janet M. Wilkens
(74) *Attorney, Agent, or Firm*—Young & Thompson

(57) ABSTRACT

A system and device for fixing a cloth, such as a tablecloth or a curtain, to a table or other surface, and also permitting to apply to the same cloth other decorative elements such as draperies. This system is includes a fixed element that is attached to the table or other surface, inside which the cloth is inserted and then blocked by a mobile element that fits into the fixed one. The mobile element has a strip of hook and eye material on its outer side, so that other accessories, such as draperies for tablecloths, may be applied.

6 Claims, 4 Drawing Sheets

U.S. PATENT DOCUMENTS 5,044,028 A 9/1991 Sleeth
5,205,337 A * 4/1993 Bozzo ..... 160/84.01
5,287,614 A * 2/1994 Ehrlich ..... 29/450
5,522,635 A * 6/1996 Downey ..... 296/100.16
5,687,459 A * 11/1997 Vanmoor ..... 24/704.1
5,906,078 A * 5/1999 Cramer ..... 52/222

* cited by examiner

FIG. 7
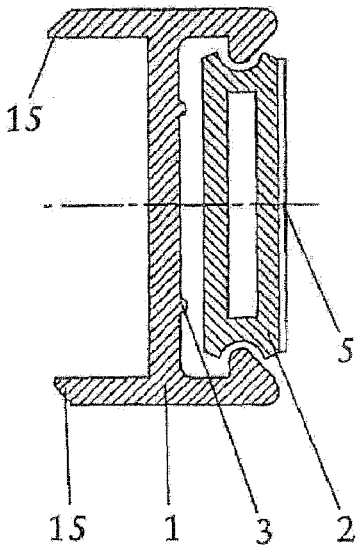
FIG. 8
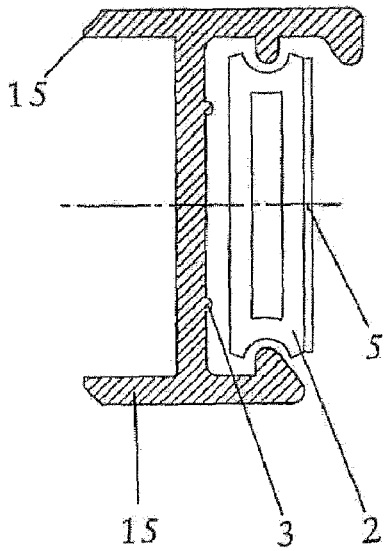
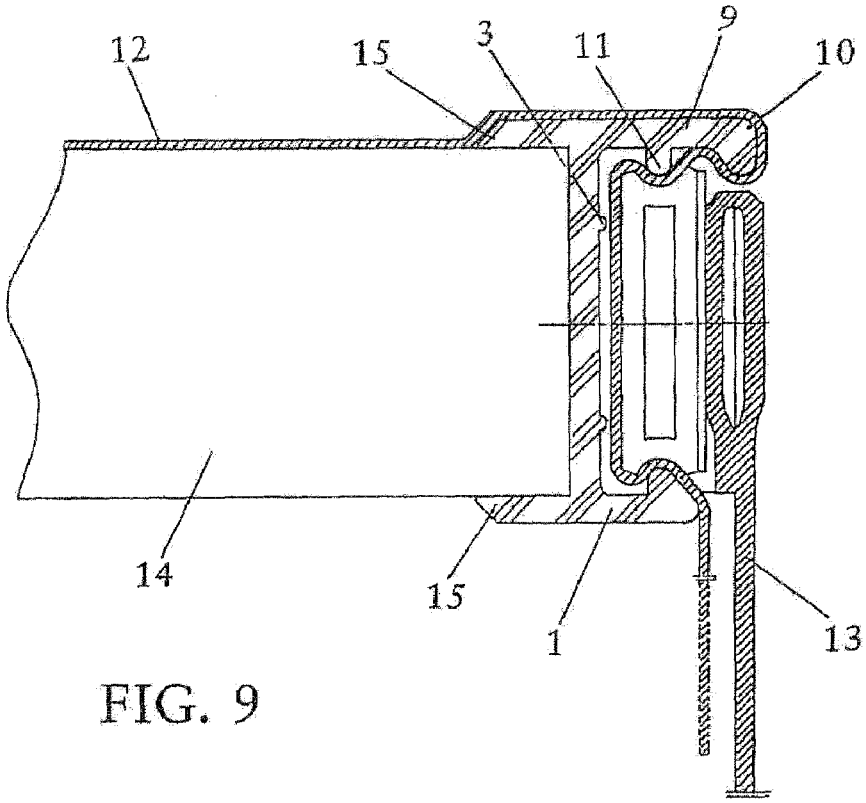
FIG. 9

SYSTEM FOR RAPIDLY FIXING A CLOTH TO A TABLE OR OTHER FLAT SURFACE

TECHNICAL FIELD

The present invention concerns the technical sector relating to the decoration of public places, such as coffee bars, restaurants or any other place provided with tables for seating customers. In particular, it concerns the technical sector relating to the production of accessories for hanging and linen, especially for tablecloths or other textiles meant for covering tables or flat surfaces in general. More specifically, the invention we are going to describe relates to the systems used in order to facilitate and improve the cover of tables, but may be used for any spreading of clothes on tables or other surfaces, including the hanging of curtains, draperies and similar.

It's obvious even to non-experts of this field that such an aspect is important for a good presentation and for the image of a public place, to such an extent that the way a table is covered and decorated results more and more sophisticated and comprises a wide range of choices. The cover of tables is also important for offering a particular image in the case of buffets or ceremonies that always require tables in perfect order with tablecloths, tablecloths-covers, draperies, well-placed on the table.

BACKGROUND ART

Nowadays, in order to keep tablecloths in place, there exist numerous systems, generally consisting of clips that are inserted by side on the borders of the table, either circular or rectangular, and that are placed over the tablecloth, pressing it against the table. This system succeeds in the aim of keeping tablecloths well spread and firm on the table and, in the case of tables placed in the open air, it also protects them from possible gusts of wind, but has the clear drawback of being barely aesthetic. As a matter of fact, the clip can be seen on the upper surface of the table and in addition, the immediate folding of the tablecloth under the side border creates unpleasant wrinkles that make the overall table look steady but not neat and tidy.

For the decoration of a table, rather than a traditional tablecloth, it may be often used a cloth covering the horizontal surface equipped on the sides of the table with a series of vertical decorative "draperies", i.e. a worked cloth fixed at the top vertical edge of the table. Nowadays, these draperies can be fixed to the table by means of suitable hooks placed at a certain distance one from the other. Said hooks are fixed to the table on the back holding the tablecloth, and have in the front a strip of Velcro over which the Velcro border of the upper inner part of the drapery sticks. This system has the relevant drawback of being barely aesthetic, since some gaps remain between one connecting point and the other and, in addition, from the top it's always possible to see a projection that lets slightly perceive the conjunction of the drapery with the table.

DISCLOSURE OF INVENTION

This invention principally aims at eliminating the above-mentioned and other drawbacks, supplying a device that, once got ready, makes the cover of the table immediately steady and the final result pleasing to look at.

The advantages resulting from the present invention essentially consist of the fact that it's possible to fix the tablecloth to the table in any position by means of a joint mechanism and, by the same system, let anyway the table ready for the immediate application of side decorative draperies of any kind; that this device can be used both for fixing the traditional tablecloth to the table so that it doesn't shift in the case of wind or sudden movements, and for the application of other decorative elements like draperies or similar; that it has a low cost and it's easy to apply.

Reduced to its essential structure and with reference to the figures of the enclosed drawings, a system for fixing a cloth or decorative elements, such as draperies and similar, to a table or other surface and/or supports, according to the invention, comprises:

- means to fix the cloth to the table, by a fixed element (1), generally having a "C" shape, which is attached to the external edge of the table, where a further mobile element (2) fits. This second element has the upper and lower sides moulded to fit into the above-mentioned fixed element, after the insertion of the cloth inside it;
- possible means to fix the drapery, or other decorative elements, to the sides of the table, by a Velcro strip (5) provided on the external surface of the mobile element (2) over which the upper border of the drapery is fixed.

Conveniently, the fixed element (1) has a "C" shape following the shape of the table to which it must be fixed and with the front part consisting of two projections (7), one upper and one lower, which end with two blunt points directed towards the inside and having such a shape as to block the mobile element that is inserted inside. The back of the fixed element that must suit the table it is applied to, may therefore take a straight or convex shape or other kind, anyway such as to suit the edge of the table.

Conveniently, the fixed element (1) has some inner bulges (3), between which the head of the screw (4) lodges, so that the inner side of the device results flat and doesn't damage the cloth after the insertion of the mobile element (2) closing the joint.

Conveniently, the fixed element (1) may have an upper part (9) that is longer than the lower one and comprises a projection (11) inside which the upper notch of the mobile element (2) fits. In this case, once the tablecloth, curtain or other cloth is fixed between the two elements and the drapery is stuck on the external Velcro (5) of the mobile element, the conjunction between the two elements results completely invisible and the drapery seems to form a single body with the tablecloth to which it's applied.

Conveniently, the fixed element (1) is fixed to the table by means of a perforating screw (4) that enters a hole (6) and screws to the same table.

Conveniently, the fixed element may be fixed to the table by means of an adhesive or biadhesive (24) or other means for this purpose, rather than the screw.

Conveniently, the fixed element may be fixed to the table by pressure, thanks to the joint that is realized between the two extensions (15) placed on its back and the edge of the same table.

Conveniently, in the above solution, the joint made on the back of the fixed element may take a straight shape, as depicted in FIGS. 7, 8 and 9, or a hollow shape or otherwise curved and shaped as to suit the edge of the table it must be fitted to.

Conveniently, the element may also be fixed to the table by the joint of a projection on its back that fits into a notch previously made on the edge of the table.

Conveniently, the fixed element (1) is applied over the entire length of the edge of the table over which the tablecloth, curtain or other cloth must be spread.

Conveniently, the mobile element (2) has a rectangular shape and such a dimension as to perfectly fit into the inner space of the fixed element (1); in addition it has, on the upper and lower part, two notches (8) that correspond to the projections (7) of the fixed element (1).

Conveniently, the notches (8) of the mobile element (2) have a rounded shape in order to facilitate their insertion by pressure inside the fixed element and suit the blunt points of its projections (7).

Conveniently, the two elements forming the device have proportional sizes compared with the ones of the edge of the table to which they must be applied.

Conveniently, the device is made of plastic material, by moulding.

In a practical solution, the system principally consists of a C-shaped element, made of a stiff plastic material, but flexible enough to permit, by pressure, a slight bend of its end projections so as to receive and hold a further element of same length, with suitable notches, which fits and blocks the tablecloth in the desired position. The principal element is equipped inside with a series of holes with flares: it will be placed over the edge of the table and fixed by means of auto-threading screws. Thanks to the flare of the hole, the fixing screw offers inside a remaining space that doesn't prevent the insertion of the second element, which has a quite rectangular shape and fits inside the C-shaped element. The mobile element is equipped at its upper and lower parts with suitable joint notches that, leaving the estimated space for the tablecloth, fit by pressure into the suitable inner projections on the extending sides of the fixed element.

This operation, obviously, will be carried out after the spread of the tablecloth, which is placed between the two elements and held in the desired position, getting the required tension on the surface of the table and the assurance of this arrangement during time. In order to increase the assurance of this arrangement, two small bulges are realized in the inner part of the fixed element that, pressing more firmly over the tablecloth, increase the steadiness of the installation. Moreover, this system has been conceived with the additional possibility to apply the side drapery; said possibility is included in the same blocking system, since the outer surface of the mobile element is large enough to contain a Velcro strip, over which the decorative drapery is stuck. In practice, with the same accessory this system provides for both the possibilities of decoration of the table realizable in a very short time thanks to the ease of installation.

A further detail of this device consists of the different shape of the principal element, fixed to the edge of the table. As a matter of fact, it may have a longer upper border; this shape aims at comprising the drapery on the sides, also preventing possible leftovers or other rests spread on the surface of the table from entering the gap between the edge of the table and the border of the drapery.

We are now going to describe how this system works.

At first, we attach the fixed element (1) to the table by suitable means like screws or similar. Later, we pass the tablecloth (12) inside the fixed element (1) firmly blocked to the table and we press on it the mobile element (2) that blocks the tablecloth between the two elements. At this point, we've realized a perfect joint capable of keeping the tablecloth firmly fixed to the table. If we want to add further decorative elements such as draperies (13), it will be sufficient to stick their inner border comprising Velcro, to the outer part of the mobile element (2), over which a strip of Velcro (5) has been applied.

Once the arrangement is completed, this invention doesn't show any constructing detail, making the final result aesthetically perfect. The cover of the table results quick, thanks to the simple insertion of the mobile joint element, so permitting to considerably save time in preparing or changing the room.

In practice, the manufacturing details may, however, vary as regards shape, size, position of elements, and type of materials used, but still remain within the range of the idea proposed as a solution and, consequently, within the limits of the protection granted by this patent for invention.

BRIEF DESCRIPTION OF DRAWINGS

These and further advantages and characteristics of the present invention can be better understood by every expert in this field by reading the following description and referring to the enclosed drawings, given as practical examples of the invention, but not to be considered restrictive.

FIGS. 7 and 8 show other two solutions of the invention that has on the back two extensions (15), one on the top and one at the base, which sets a space into which the edge of the table fits by pressure.

FIG. 9 shows, finally, the same practical solution as FIGS. 7 and 8, with the element fitted to the table (14) and the cloth (12) applied.

Figure 1A:
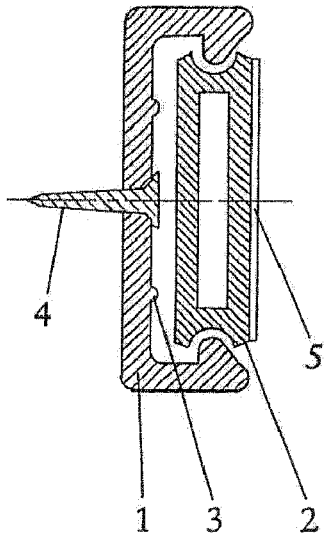
FIG. 1 shows the section of the two elements assembled together and exploded, in particular: the fixed element (1), having a "C" shape and an inner flared hole (6) for the lodge of the screw (4) necessary for previously fixing the same element to the edge of the table. The extending parts end with a projection towards the inside (7) that fits into the suitable notch (8) made on the mobile element (2) that the user will insert by pressure when preparing the table. Obviously, the space between the projection (7) and the notch (8) will vary according to the thickness of the tablecloth to hold. The steadiness of the assembly is additionally assured by the two bulges (3) made inside the fixed element (1), which first are pressed against the tablecloth when inserting the mobile element (2) that has a strip of Velcro (5) on its outer part.
Figure 1B:
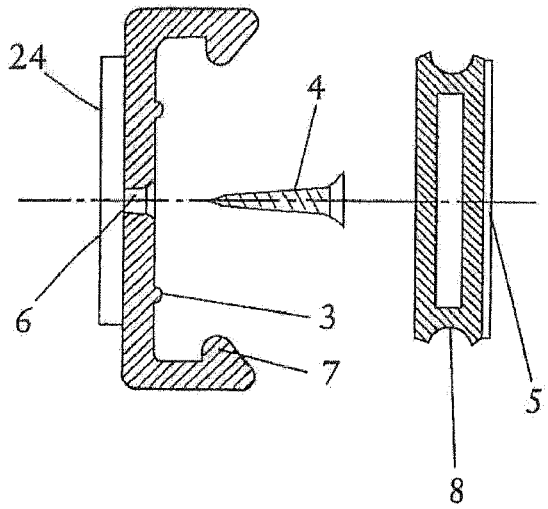
Figure 2A:
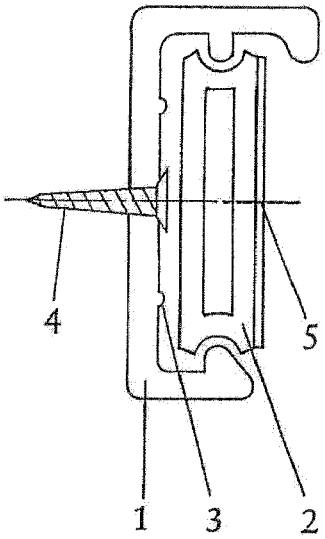
FIG. 2 shows a different shape of the principal fixed element (1), which is asymmetrical in its upper side (9): it has an inner projection (11), perpendicular and however on the same axis as the corresponding lower one (7), and ends with a joint projection (10) that, as we'll see later, will hold the drapery. In any case, whatever principal element is chosen, the mobile joint element rests geometrically unchanged, therefore universal.
Figure 2B:
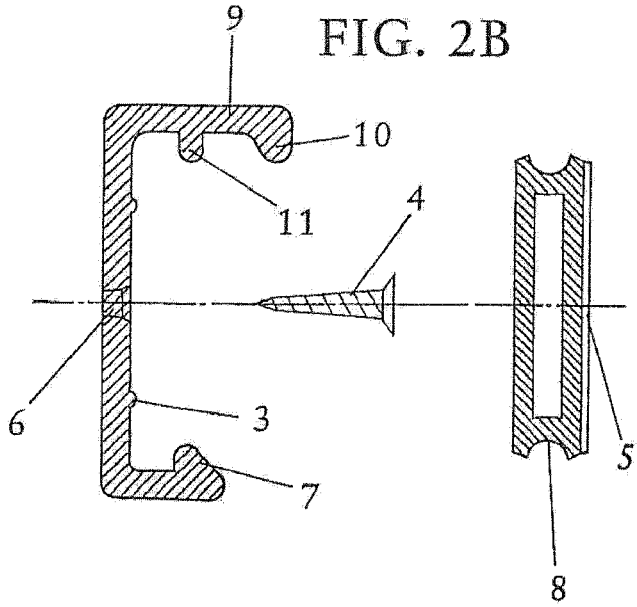
Figure 3:
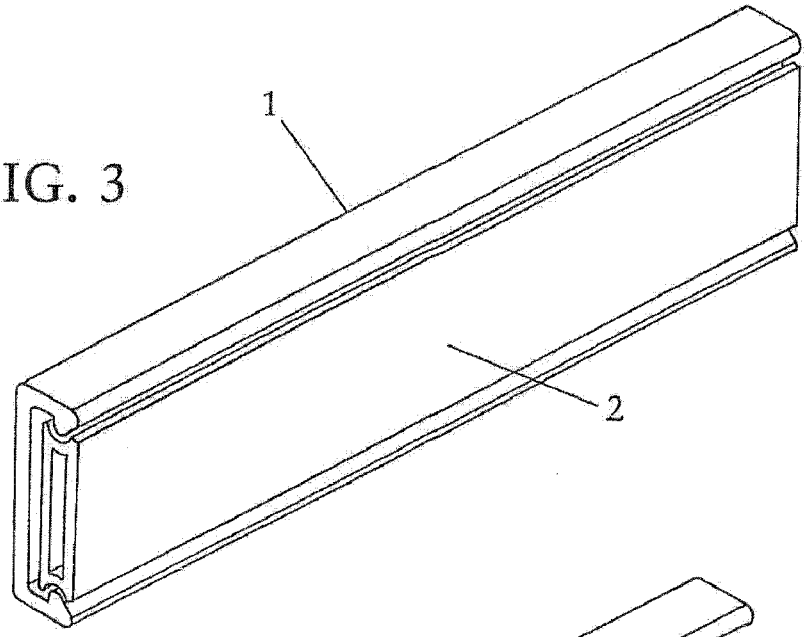
FIG. 3 shows a perspective view of a portion of the two elements (1, 2) assembled together.
Figure 4:
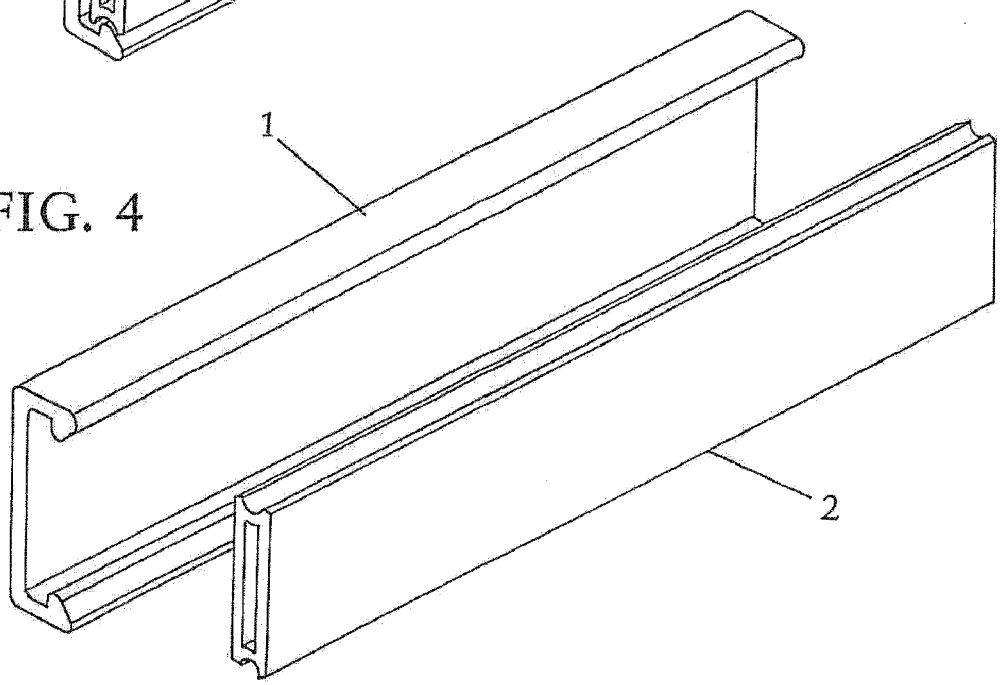
FIG. 4 shows the same perspective view of the elements, but divided one from the other.
Figure 5A:
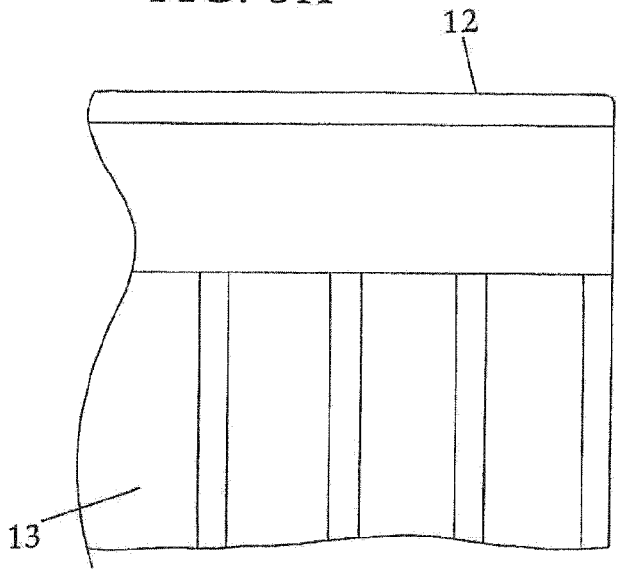
FIG. 5 proves the functionality of this invention showing the tablecloth (12) inside the two elements (1, 2); the principal element is attached to the edge of the table (14) by means of screws (4) and has two bulges (3) that form a single plane with the head of the screw; the mobile element (2) is depicted as inserted inside. The tablecloth is blocked by the joints (7). On the outer surface of the element (2) the Velcro strip (5) is placed, which anchors the border of the drapery (13).
Figure 5B:
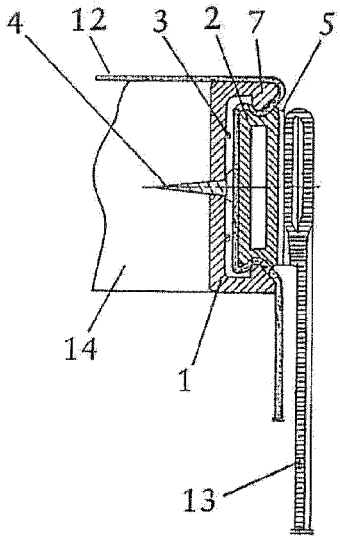
Figure 6A:
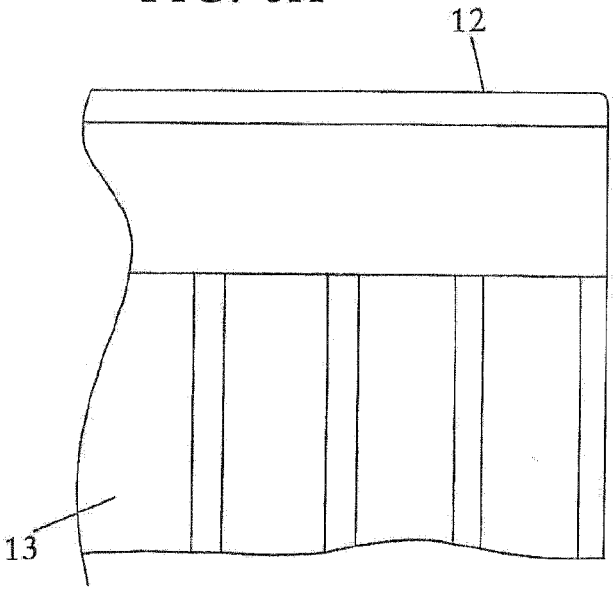
FIG. 6 shows a different practical solution where the fixed element (1) has an upper extension (9) that covers the upper border of the drapery (13), once applied to it.
Figure 6B:
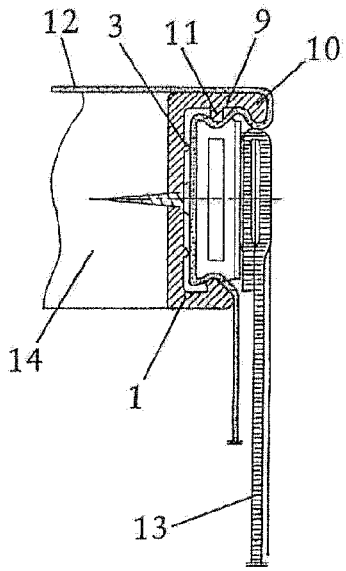

The invention claimed is:

1. System and device for fixing a cloth and decorative elements to a table, comprising:

a mobile element;

a fixed element comprising i) a rectangular hollow shape shaped for attachment to an external edge of the table and ii) a front part comprising two projections which block the mobile element when inserted inside the fixed element; and the mobile element comprising a flat rectangular surface with a dimension to fit into an inner space of the fixed element so that upper and lower sides of the mobile element are blocked by the two projections upon insertion of the cloth between the fixed element and the mobile element, wherein, the fixed element has an upper part that is longer than a corresponding lower part and comprises a further projection which fits into an upper notch of the mobile element.

2. System and device as claimed in claim 1, wherein the fixed element comprises a screw hole (6) for receiving a screw to attach the fixed element to the table.

3. System and device as claimed in claim 1, characterized in that the fixed element further comprises an adhesive or biadhesive.

4. System and device as claimed in claim 1, in combination with the table and wherein the fixed element is applied over the entire length of the external edge of the table.

5. System and device as claimed in claim 4, characterized in that the upper notch of the mobile element has a rounded shape.

6. System and device as claimed in claim 4, wherein the fixed element and the mobile element have proportional sizes compared with a size of the edge of the table.

* * * * *